US008622619B2

(12) United States Patent
Adams et al.

(10) Patent No.: US 8,622,619 B2
(45) Date of Patent: Jan. 7, 2014

(54) PACKAGING

(75) Inventors: Michael Kenneth John Adams, Winscombe (GB); John Fairweather, Failand (GB)

(73) Assignee: Amcor Flexibles ApS, Horsens (DK)

( * ) Notice: Subject to any disclaimer, the term of this patent is extended or adjusted under 35 U.S.C. 154(b) by 741 days.

(21) Appl. No.: 11/721,048

(22) PCT Filed: Dec. 12, 2005

(86) PCT No.: PCT/GB2005/004790
§ 371 (c)(1), (2), (4) Date: Aug. 7, 2009

(87) PCT Pub. No.: WO2006/061654
PCT Pub. Date: Jun. 15, 2006

(65) Prior Publication Data

US 2009/0297074 A1 Dec. 3, 2009

(30) Foreign Application Priority Data

Dec. 10, 2004 (GB) ..... 0427140.9

(51) Int. Cl.

| | |
|---|---|
| ***B65D 33/00*** | (2006.01) |
| ***B65D 30/16*** | (2006.01) |
| ***B65D 30/08*** | (2006.01) |
| ***B65D 33/02*** | (2006.01) |
| ***B65D 30/20*** | (2006.01) |
| ***B65D 30/10*** | (2006.01) |

(52) U.S. Cl.
USPC ..... 383/207; 383/104; 383/105; 383/116; 383/119; 383/120; 383/121

(58) Field of Classification Search
USPC ..... 383/207–209, 104, 120, 116, 105, 121
See application file for complete search history.

(56) References Cited

U.S. PATENT DOCUMENTS 3,228,584 A * 1/1966 Ashton ..... 383/203
3,456,867 A 7/1969 Repko (Continued)

FOREIGN PATENT DOCUMENTS

DE 3600501 1/1986
DE 3600501 A1 * 5/1987

(Continued)

OTHER PUBLICATIONS

Translation of German Document No. 36 00 501. Translated on Nov. 30, 2012.*

(Continued)

*Primary Examiner* — Jes F Pascua
(74) *Attorney, Agent, or Firm* — Reising Ethington P.C.

(57) ABSTRACT

A package has a flexible top wall (3) joined at its periphery (6) to flexible side walls (4, 5) to form an enclosure, the top wall (3) being formed with a line of weakness (7) which is adapted to be torn to create an opening, the tear being confined between the peripheral join (6). The side walls (4, 5) may have transverse seals (1, 2), and top and bottom walls (3) folded inwards as gussets, and the line of weakness (7) extends substantially centrally along the fold line of the gusseted top wall (3) between the two transverse seals (1, 2). The package is easily gripped in both hands, one either side of the line of weakness (7), with a thumb on each side to press downwards and create a tear along the line of weakness. Preferably, the upper edges of the side walls (4, 5) are sealed to the adjoining edges of the top wall (3) to form a peripheral upstanding rim (6).

28 Claims, 3 Drawing Sheets

(56) References Cited

U.S. PATENT DOCUMENTS

| | | | | |
|---|---|---|---|---|
| 3,519,197 | A * | 7/1970 | Campbell | 383/203 |
| 3,935,993 | A * | 2/1976 | Doyen et al. | 383/94 |
| 4,252,269 | A | 2/1981 | Peppiatt | |
| 4,573,203 | A * | 2/1986 | Peppiatt | 383/29 |
| 4,576,316 | A * | 3/1986 | Foster | 222/541.6 |
| 4,713,839 | A | 12/1987 | Peppiatt | |
| 4,721,396 | A | 1/1988 | Sengewald | |
| 4,744,466 | A | 5/1988 | Hall | |
| 4,867,575 | A | 9/1989 | Wood | |
| 4,877,335 | A | 10/1989 | Barnard | |
| 5,112,138 | A | 5/1992 | Peppiatt | |
| 5,158,499 | A * | 10/1992 | Guckenberger | 206/524.2 |
| 5,282,687 | A * | 2/1994 | Yee | 383/25 |
| 6,030,652 | A | 2/2000 | Hanus | |
| 6,076,968 | A | 6/2000 | Smith et al. | |
| 6,213,645 | B1 * | 4/2001 | Beer | 383/211 |
| 6,446,796 | B1 | 9/2002 | Schmidt | |
| 6,601,705 | B2 * | 8/2003 | Molina et al. | 206/494 |
| 6,635,039 | B1 | 10/2003 | Levy | |
| 6,729,112 | B2 * | 5/2004 | Kuss et al. | 53/551 |
| 8,256,616 | B2 * | 9/2012 | Eilert | 206/391 |
| 8,281,926 | B2 * | 10/2012 | Messerschmidt et al. | 206/459.5 |
| 2005/0084186 | A1 * | 4/2005 | Caris | 383/203 |
| 2006/0124494 | A1 * | 6/2006 | Clark et al. | 206/440 |

FOREIGN PATENT DOCUMENTS

| | | | |
|---|---|---|---|
| DE | 39 14 595 | | 11/1990 |
| DE | 3914595 | | 11/1990 |
| DE | 295 09 053 | | 8/1995 |
| DE | 10101661 | A1 * | 7/2002 |
| EP | 0 380 111 | | 8/1990 |
| EP | 0380111 | | 8/1990 |
| EP | 0473089 | | 3/1992 |
| EP | 0 945 360 | | 9/1999 |
| EP | 1 437 311 | | 7/2004 |
| EP | 0437311 | | 7/2004 |
| EP | 1508531 | | 2/2005 |
| GB | 2 158 033 | | 11/1985 |
| GB | 2158033 | | 11/1985 |
| GB | 2 350 103 | | 11/2000 |
| GB | 2421013 | | 11/2007 |
| JP | 56-14535 | | 4/1981 |
| JP | 1-91753 | | 6/1989 |
| JP | 4-226607 | | 8/1992 |
| JP | 5-310257 | | 11/1993 |
| JP | 7-187198 | | 7/1995 |
| JP | 07-187198 | | 7/1995 |
| JP | 3047987 | | 2/1998 |
| JP | 11-276313 | | 10/1999 |
| JP | 2001-080649 | | 3/2001 |
| JP | 2001-80649 | | 3/2001 |
| JP | 2001-247181 | | 9/2001 |
| JP | 2002-540024 | | 11/2002 |
| JP | 2004-306997 | | 4/2004 |
| JP | 2004-306997 | | 11/2004 |
| WO | WO 03/051730 | | 6/2003 |
| WO | WO 2004/043811 | | 5/2004 |
| WO | 2004/101388 | | 11/2004 |
| WO | 2004/101388 | A2 | 11/2004 |
| WO | 2004061654 | | 6/2006 |

OTHER PUBLICATIONS

International Search Report for PCT Application No. PCT/GB2005/004790; Filed Dec. 12, 2005; Date of Completion May 18, 2006; Date of Mailing May 29, 2006.

European Search Report for European Application No. 0427140.9; Filed Dec. 10, 2004.

JP Notice of Grounds for Rejection May 26, 2011 in JP 2007-544995.

The Patent Office of the State Intellectual Property Office of the People's Republic of China, First Office Action for Application No. 2005 80042435.1, Mar. 13, 2009, 7 pages.

The Patent Office of the State Intellectual Property Office of the People's Republic of China, Third Office Action for Application No. 2004 80042435.1, Dec. 4, 2009, 6 pages.

The State Intellectual Property Office of the People's Republic of China, Fourth Office Action for Application No. 2005 80042435.1, Jul. 14, 2010, 5 pages.

Intellectual Property Office of New Zealand, Examination Report for Patent Application No. 555736, Jun. 19, 2009, 1 page.

Intellectual Property Office of New Zealand, Examination Report for Patent Application No. 555736, May 27, 2010, 2 pages.

Intellectual Property Office of New Zealand, Examination Report for Patent Application No. 555736, Aug. 27, 2010, 2 pages.

Official Action (English version), Russian Patent Application No. 2007 123463, Oct. 27, 2009, 2 pages.

Official Action, and translation, Russian Patent Application No. 2007 123463, Apr. 5, 2010, 5 pages.

Ministry of Education and Science of Ukraine, State Intellectual Property Department, Institute of Industrial Property of Ukraine, Preliminary Conclusion, Application No. 2007 06429, Apr. 7, 2009, 2 pages.

H. Ishida, Notice of Grounds for Rejection (translation), Japanese Patent Application No. 2007-544995, Jan. 12, 2012, 2 pages.

Examination Report Under Section 18(3), UK Intellectual Property Office, Apr. 19, 2007, p. 1.

Translation of Decision of Rejection, Jan. 10, 2013, 2 pages, Japan.

* cited by examiner

PACKAGING

CROSS-REFERENCE TO RELATED APPLICATIONS

This application is a 371 of PCT/GB05/04790, filed Dec. 12, 2005, and GB 0427140.9, filed Dec. 10, 2004.

BACKGROUND

1. Field

This invention relates to packaging and packages, especially flexible packages, which are easily openable to allow the consumption of products contained therein.

2. Description of Related Art Including Information disclosed under 37CFR 1.97and 1.98

A known type of flexible package is described in WO200058174 in the form of a stand up bag comprising two side walls joined by top and bottom walls formed with gussets so that they each fold inwards of the package when in the flattened form. In manufacture, the side walls and top and bottom walls are formed as a tube which is closed each end by transverse seals which run the full width of the side walls to form an enclosure. Furthermore, the edges of the side walls where they join the top and bottom walls along fold lines are sealed to the adjoining edges of the top and bottom walls to form upstanding peripheral walls or rims which increase rigidity of the package. When a pack of this type is filled with a product it maintains a rectangular shape that will stand unsupported and presents good side walls for the presentation of information relating to its contents.

An object of the invention is to provide an improved package incorporating an easy open feature.

SUMMARY

According to one aspect, the invention comprises a package having a flexible top wall joined at its periphery to flexible side walls to form an enclosure, the top wall being formed with a line of weakness which is adapted to be torn to create an opening in the top wall, the tear being confined between the peripheral join of the top wall with the side walls.

In a preferred embodiment, the invention is applied to a package of the known type described above comprising side walls with transverse seals, and top and bottom walls folded inwards as gussets. Prior to assembly of the package, that portion which forms the top wall is formed with a line of weakness which extends across the top wall and allows it to be opened by inward pressure on the top wall to create a tear along the line of weakness. Preferably, the line of weakness extends substantially centrally along the fold line of the gusseted top wall between the two transverse seals that permanently close the package, and the package is easily gripped in both hands, one either side of the line of weakness, with a thumb on each side to press downwards and create a tear along the line of weakness. Preferably, the upper edges of the side walls are sealed to the adjoining edges of the top wall to form a peripheral upstanding rim which, as well as adding rigidity to the package in the known manner, further facilitates gripping of the top portions of the package either side of the line of weakness.

Once opened, a package according to this embodiment of the invention, allows the two portions of the top wall either side of the tear along the line of weakness to be folded inwards and downwards against the surrounding side walls of the package so as to leave an unobstructed opening of maximum size corresponding to the outline defined by the upstanding peripheral rim, and the torn portions of the top wall serve to line and reinforce the side walls below the upstanding rim. The folded sealed edges which form the upstanding rim serve to hold the torn portions of the top wall against the side walls. Therefore, in its open state, the package forms a container similar to a cup with an open top to allow maximum access to its contents and which is convenient to handle while the product is consumed. The packaging can then be disposed of in a tidy manner without having previously generated any additional potential litter in the form of tear strips or other torn packaging created during the opening process.

Other aspects of the invention are defined in the accompanying claims.

BRIEF DESCRIPTION OF THE SEVERAL VIEWS OF THE DRAWINGS

The invention will now be described by way of example with reference to the accompanying drawings in which.

DETAILED DESCRIPTION

Figure 1:
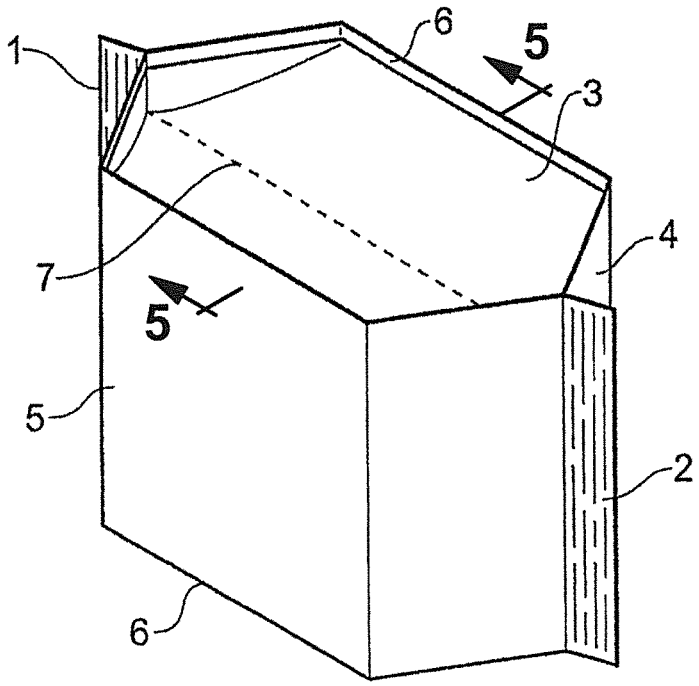
FIG. 1 is an isometric top view of a package according to an embodiment of the invention.
Figure 4:
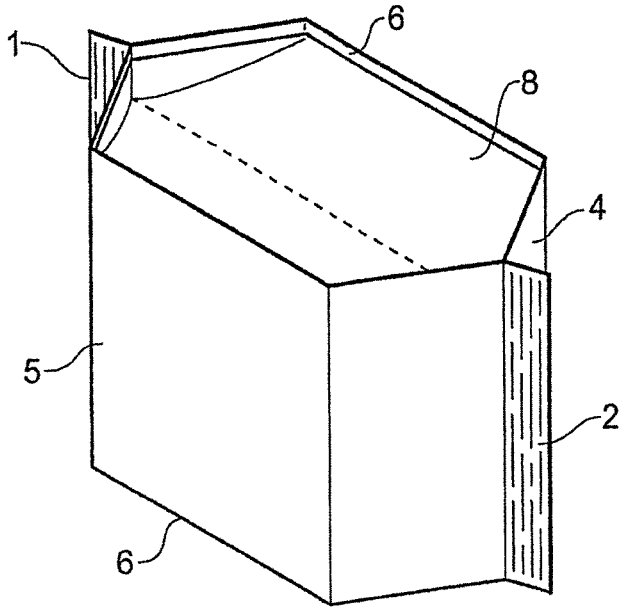
FIG. 4 is an isometric bottom view of the package of FIG. 1.

In general terms, FIGS. 1 and 4 illustrates a stand up bag of the known type composed of flexible plastics film which is formed into a tubular shape in a continuous flow process, with gusseted side walls that fold inwards. A bag or package is formed by severing a length of the tubular film from a continuous length and closing the cut ends by seals extending laterally of the length of the tube. As shown in FIG. 1, the seals are shown as sealed flaps 1 and 2, which are upright in the finished package. The gusseted side walls become the top and bottom walls 3, 8 of the package and are unfolded by the products deposited in the package during the packaging process before the second of the seals 1, 2 is formed to close the package. The gusseted side wall forming the top wall of the package is shown as 3 in FIG. 1. The gusseted side wall forming the bottom wall of the package is shown as 8 in FIG. 4.

Another known feature of this type of stand up bag is to heat seal peripheral portions of the top and bottom walls to the adjoining portions of the upright side walls 4, 5 so as to form an upstanding wall or rim 6 which gives a better definition to the shape of the package.

The easy open feature according to the invention consists in providing a line of weakness 7 in the top wall 3 of the package, and, as shown in FIG. 1, this extends substantially along the centre fold which forms the gusset in the wall production. The line of weakness is preferably formed as a continuous formation in the side wall 3 and therefore extends fully between the two seals 1 and 2.

Figure 2:
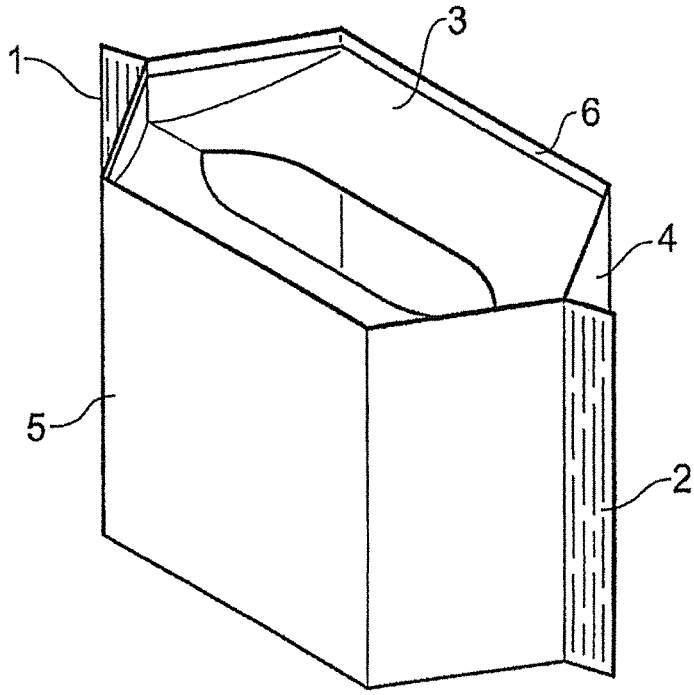
FIG. 2 is an isometric top view of the package of FIG. 1 in a partially open state.
Figure 3:
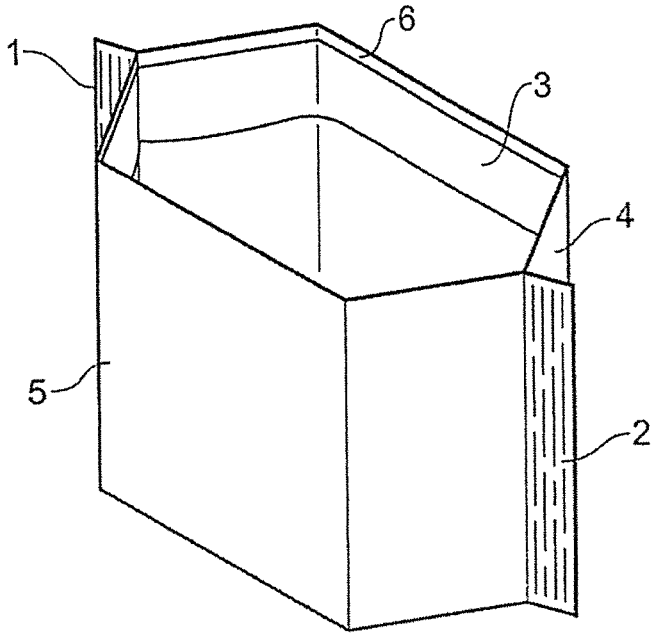
FIG. 3 is an isometric top view of the package of FIG. 1 in the fully open state.

The opening process of the package simply involves a consumer gripping the top of the pack either side of the line of weakness 7 and either pulling either side of the top wall 3 apart to create a tear along the line of weakness 7, or pressing downwards with thumbs either side of the line of weakness 7 so as to create the tear along the line of weakness, as shown in FIG. 2. The two portions of the top wall either side of the tear can be further pushed inwards against the adjacent upright side walls 4, 5 of the package so as to leave a completely unobstructed opening defined by the upstanding rim 6 around the top of the package, as shown in FIG. 3. The fact that the line of weakness 7 extends across the full width of the top wall 3 ensures that the opening created by the tear also extends the full width of the top wall to allow the maximum opening. With the two torn portions of the top wall 3 folded against the adjacent upright walls 4, 5, not only does this create the maximum possible opening, but also forms a double layer of material around the top of the package as an extension to the rim 6 which provides increased reinforcement or stiffness to make the open package more like a cup for convenience of use by the consumer when consuming the contents. The upstanding rim serves to help hold the two torn portions of the top wall 3 against the adjacent upright walls 4, 5. Without the upstanding rim, the natural lack of foldability of the plastics film would cause the torn portions to return to the closed position and obstruct the torn opening.

Figure 5:
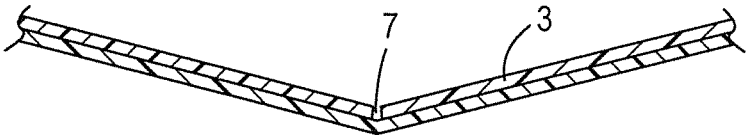
FIG. 5 is a partial cross-sectional view of the package of FIG. 1 taken along line 5-5 of FIG. 1.

In one embodiment of the invention, and as best shown in FIG. 5, the plastics film that forms the package is a two layer laminate comprising inner and outer layers suited to different purposes including allowing heat sealing of the film to itself, providing a suitable contact layer and protective film for the contents of the package, and providing a suitable external layer for printing and other packaging purposes. Typically, the outer layer may be orientated polypropylene OPP, orientated polyester OPET, or orientated polyamide OPA, and the inner layer is polyethylene PE or non-orientated polypropylene PP. In other embodiments of the invention, a laminate film may be used having three or more layers.

The line of weakness 7 in the top wall 3 may be formed by perforations in the outer layer of the laminate film, these perforations being formed before the lamination of the inner and outer layers. The perforations are therefore sealed by the inner layer until the line of weakness is torn in opening the package. The plastics composition of the inner layer and its thickness are selected to facilitate the tearing process, and the composition of the material of the outer layer is also selected to ensure that the applied tension during the opening process is generally withstood until the line of weakness fails. In a typical example using polyethylene film, the inner layer may be 20-70 micron thick. Preferably, the polyethylene film is formulated to enable the laminate to be split more readily. For example, polyethylene films which are blends of different polyethylene grades containing a proportion of medium or high density polyethylene have been found to be particularly suitable for this purpose.

The perforations in the line of weakness 7 may be formed by any suitable means including mechanical or laser means. Laser perforation means may be used to form the perforations in a laminate film after lamination.

In an alternative embodiment of the invention, instead of providing perforations, a continuous slit may be provided in the outer layer.

Furthermore, instead of a single line of weakness 7 as shown in FIG. 1, multiple parallel lines of weakness may be formed in the region of the centrefold of the top wall so as to allow for variation in the positioning of the centrefold of the package during the manufacturing process. That is, the multiple lines of weakness are preformed in the web that is eventually folded to form the side wall, and any lateral change in the position of the centre fold will then be accommodated by substantial alignment with at least one of the lines of weakness. The lines of weakness would typically be spaced 1 mm apart.

In an alternative embodiment of the invention, a monolayer film may be used for the packaging, and the line of weakness may be formed by means which still preserves the barrier properties of the top wall, for example, by local thinning of the thickness of the film along the line of weakness, or, if suitable for the contents, the line of weakness may involve perforations which penetrate the film and break the barrier properties of the top wall.

In yet another embodiment of the invention, the line of weakness or parallel lines of weakness are offset from the centre fold of the gusset towards the junction of the top wall 3 with a side wall 4 or 5 so that a folded portion of the top wall 3 folds back against the opposite side wall 5 or 4.

In yet another embodiment of the invention, an opening may be provided in the top wall 3 by a line of weakness defining a portion of the wall which is to be displaced or removed on opening of the package. The line of weakness would then include portions that extend substantially laterally of the fold line of the top wall 3.

In yet another embodiment of the invention, the line of weakness may be a cut in the top wall which is covered by a pressure sensitive adhesive label, the label being removed in order to create an opening in the top wall. The line of weakness may be formed by a die-cutting process.

In any of the above embodiments of the invention, a reclose device such as a pressure sensitive adhesive label may be provided that can be used to close the opening after it has been formed by tearing the line of weakness. This label may be attached to the top wall 3 to cover the line of weakness before it is torn, the label first being removed to allow the opening. Alternatively, the label may be attached to the packet elsewhere.

In yet another embodiment of the invention, the top wall may be composed of an easy tear film which tears easily in a preferred direction, which direction would be aligned to extend between the two upright seals 1 and 2 of the package in FIG. 1.

It will be appreciated that the. terminology "top", "bottom" and "side" as used in this application is not intended to be limitative, and that a package according to the invention may assume any orientation in use. However, it is a common practice to stack packages upright and to provide for them to be opened at the top as a matter of convenience.

The invention claimed is:

1. A package having a flexible top wall joined at its peripheral edges to peripheral edges of flexible side walls to form an enclosure, peripheral edges of the top wall being bonded to peripheral edges of the side walls to form an upstanding peripheral rim, and the top wall being formed as a gusset that folds inwards of the enclosure with gusset panels extending inwards from said rim towards one another, the top wall including a line of weakness along which the top wall is adapted to be opened and said gusset panels folded inwards towards the side walls to form an opening, the upstanding peripheral rim being arranged to bias the gusset panels against the side walls following opening of the package.

2. A package as claimed in claim 1 in which the line of weakness is formed along or parallel to a fold line of the top wall between the gusset panels.

3. A package as claimed in claim 1 or 2 comprising two side walls joined by upright seals on opposite sides of the package with the line of weakness extending continuously between the seals across the mid-region of the top wall.

4. A package as claimed in either of claim 1 or 2 in which the top wall is formed by a monolayer sheet which is thinned locally along the line of weakness.

5. A package as claimed in claim 1, comprising a bottom wall with a peripheral edge sealed to peripheral edges of the side walls to form a lower rim.

6. A package as claimed in claim 5 in which the bottom wall is formed as a gusset that folds inwards of the enclosure with gusset panels that extend inwards from said lower rim towards one another.

7. A package as claimed in claim 1 in which the top wall is formed by a laminated sheet with an inner layer to suit products to be packed, and an outer layer in which the line of weakness is formed.

8. A package as claimed in claim 7 in which the line of weakness is formed by perforations or a cut or a thinned portion of the outer layer.

9. A package as claimed in claim 7 or 8 in which the inner layer is composed of material which will more easily stretch and tear than the outer layer.

10. A package as claimed in claim 1 in which the top wall is formed by a film of material which has the property of tearing preferentially in a particular direction, this direction being aligned with the line of weakness.

11. A package as claimed in claim 1 in which the top wall is adapted to form an opening of unobstructed maximum size corresponding to an outline defined by the upstanding peripheral rim, when the gusset panels are folded inwards against the side walls.

12. A package having a flexible top wall joined at its peripheral edges to peripheral edges of flexible side walls to form an enclosure, peripheral edges of the top wall being bonded to peripheral edges of the side walls to form an upstanding peripheral rim, and the top wall being formed as a gusset that folds inwards of the enclosure with gusset panels extending inwards from said rim towards one another, the top wall including a line of weakness along which the top wall is adapted to be opened and said gusset panels folded inwards towards the side walls to form an opening, the upstanding peripheral rim being arranged to hold the gusset panels against the side walls following opening of the package to reinforce the side walls below the upstanding peripheral rim.

13. A package as claimed in claim 12 in which the line of weakness is formed along or parallel to a fold line of the top wall between the gusset panels.

14. A package as claimed in claim 13 comprising two side walls joined by upright seals on opposite sides of the package with the line of weakness extending continuously between the seals across the mid-region of the top wall.

15. A package as claimed in claim 14 comprising a bottom wall with a peripheral edge sealed to peripheral edges of the side walls to form a lower rim.

16. A package as claimed in claim 13 comprising a bottom wall with a peripheral edge sealed to peripheral edges of the side walls to form a lower rim.

17. A package as claimed in claim 13 in which the top wall is formed by a monolayer sheet which is thinned locally along the line of weakness.

18. A package as claimed in claim 12 comprising two side walls joined by upright seals on opposite sides of the package with the line of weakness extending continuously between the seals across the mid-region of the top wall.

19. A package as claimed in claim 18 comprising a bottom wall with a peripheral edge sealed to peripheral edges of the side walls to form a lower rim.

20. A package as claimed in claim 12 comprising a bottom wall with a peripheral edge sealed to peripheral edges of the side walls to form a lower rim.

21. A package as claimed in claim 20 in which the bottom wall is formed as a gusset that folds inwards of the enclosure with gusset panels that extend inwards from said lower rim towards one another.

22. A package as claimed in claim 12 in which the top wall is formed by a laminated sheet with an inner layer to suit products to be packed, and an outer layer in which the line of weakness is formed.

23. A package as claimed in claim 22 in which the line of weakness is formed by perforations or a cut or a thinned portion of the outer layer.

24. A package as claimed in claim 23 in which the inner layer is composed of material which will more easily stretch and tear than the outer layer.

25. A package as claimed in claim 22 in which the inner layer is composed of material which will more easily stretch and tear than the outer layer.

26. A package as claimed in claim 12 in which the top wall is formed by a monolayer sheet which is thinned locally along the line of weakness.

27. A package as claimed in claim 12 in which the top wall is formed by a film of material which has the property of tearing preferentially in a particular direction, this direction being aligned with the line of weakness.

28. A package as claimed in claim 12 in which the top wall is adapted to form an opening of unobstructed maximum size corresponding to an outline defined by the upstanding peripheral rim, when the gusset panels are folded inwards against the side walls.

* * * * *

UNITED STATES PATENT AND TRADEMARK OFFICE

CERTIFICATE OF CORRECTION

PATENT NO. : 8,622,619 B2
APPLICATION NO. : 11/721048
DATED : January 7, 2014
INVENTOR(S) : Michael Kenneth John Adams It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1535 days.

Signed and Sealed this
Second Day of June, 2015

Michelle K. Lee

Michelle K. Lee
*Director of the United States Patent and Trademark Office*